United States Patent [19]

Aurit

[11] 4,363,197

[45] Dec. 14, 1982

[54] ADJUSTABLE SUPPORT ROLLAWAY BLEACHER

[76] Inventor: Dale Aurit, 3101 S. Lincoln, Sioux Falls, S. Dak. 57102

[21] Appl. No.: 212,830

[22] Filed: Dec. 4, 1980

[51] Int. Cl.[3] ..... E04H 3/12

[52] U.S. Cl. ..... 52/9

[58] Field of Search ..... 52/9, 10, 8, 183; 182/131

[56] References Cited

U.S. PATENT DOCUMENTS

| | | | |
|---|---|---|---|
| 2,706,835 | 4/1955 | Ullom | 52/9 |
| 2,870,492 | 1/1959 | Chervenka | 52/9 |
| 4,045,921 | 9/1977 | Molloy | 52/9 |

*Primary Examiner*—J. Karl Bell

*Attorney, Agent, or Firm*—James T. FitzGibbon

[57] ABSTRACT

A reinforced folding bleacher support structure and method of reinforcing existing folding bleachers. The improvement includes an adjustable brace structure which fits snugly over and reinforces the column support, and includes a pivoted adjustable horizontally extending brace. The horizontal brace pivots about a lower part of the vertical brace, and engages the column on both front and rear faces. Bending forces applied to the horizontal brace are transmitted to the vertical structure through a face plate abutted by a portion of the adjustment mechanism. The method includes reinforcing the column near the top portion thereof, positioning the horizontal brace and then adjusting it by manipulating the mechanism until the support structure is level for proper extension and retraction.

6 Claims, 4 Drawing Figures

ADJUSTABLE SUPPORT ROLLAWAY BLEACHER

The present invention relates generally to improved seating structures, and more particularly, to an apparatus for improving the performance of telescoping spectator seating, commonly referred to as rollaway or storable type bleachers.

Over the past five to twenty years, or more, many schools or other institutions have seen fit to install folding bleacher type seating for use by students or other spectators, who are able to attend assemblies, see indoor games such as basketball and volleyball games, gymnastic routines, and to witness dramatic presentations, band concerts and the like while seated comfortably.

At the same time, the rollaway or fold-and-storage capability of the bleachers justifies investment in their added expense. When the bleachers are retracted for storage, more indoor floor space is available for other activities, for ease of maintenance and for other purposes as well. In addition the use of storable or rollaway bleachers decreases the likelihood of accidents which might occur on conventional bleachers which remain erected at all times.

However, because of the expense of installing rollaway bleachers, it is desirable that they be constructed so as to endure rather severe use over a long period of time. While many prior art bleachers have been characterized by the above and other advantages after a number of years, they develop distortion at certain points in the structure and this chronic difficulty in being extended or retracted makes it impossible to retract them. This occurs because a portion of the seat support structure deflects or takes a "set" as a result of bending or buckling in use. Consequently, a particular portion of the bleachers is lowered below its design position, and when an attempt is made to retract the portion of the seat lying therebelow, physical interference is created and the bleachers cannot be retracted. Once retracted or rolled away, then the bleachers become difficult or impossible to be extended for use because of this same interference.

After the bleachers have attained this condition, it is usually necessary to install all new structural components, or to attempt to bend them back to their original dimensions. This is normally attempted on a job-to-job basis but is difficult or impossible without the use of jigs or fixtures which insure that the bleachers will be returned exactly to their originally aligned position of use.

Moreover, having been once bent or twisted, the fatigue resistance of the metal diminishes, and the bleachers are prone to deflect again soon after being straightened. After one or more expensive repair or service calls, the bleachers are more or less beyond normal repair, and the bleachers themselves or their major components must be replaced entirely or their use discontinued.

The foregoing situation is aggravated by recent economic conditions which have seen many expensive school facilities fall into relative disuse because of diminishing population trends. Accordingly, school administrators or their counterparts in other organizations are reluctant or unable to purchase replacement equipment, but are equally reluctant or unable to engage in expensive repair and rehabilitation work, with the consequence that expensive bleachers fall into disuse and fail to provide the utilization anticipated when they were purchased.

According to the invention, a simplified reinforcing and positioning structure is provided for the portions of the bleachers which have proven to fail in use. This structure features not only improved strength at low cost, easy adaptability and mounting to existing bleachers, but also includes an easy adjustment and alignment feature whereby bleachers may be brought back to their original condition of alignment, will extend and retract as originally designed, and will withstand continued wear at reduced or substantially zero maintenance costs.

In view of the failure of the prior art to provide such a product, it is an object of the present invention to provide an improved reinforcing and adjusting member for rollaway bleachers.

Still another object of the invention is to provide a structure which may be attached to existing bleachers to strengthen structural selected portions thereof.

Yet another object is to provide an easily installed adjustable strengthening support member for rollaway bleachers.

A still further object of the invention is to provide an improved bleacher structure which is capable of displaying longer life at reduced cost, ease of maintenance and which, when out of adjustment, is easy to recondition or realign or for use over an extended time.

Another object of the invention is to provide a structure for reinforcing the joint between the horizontal and the vertical elements of the bleacher seat support system.

Another object is to provide a bleacher support unit adapted to be affixed in place adjacent to the junction between the vertical and the horizontal elements which position the seat and floor support members of rollaway bleachers, including a simplified adjusting and locking mechanism for one portion of the reinforcing structure.

A further object is to make an easily adjustable, easily affixed, generally L-shaped bleacher seat and floorboard support structure, particularly a structure which is easily installed and brought into position of alignment.

The foregoing and other objects of the invention are achieved in practice by providing an improved bleacher construction, and more particularly, an assembly comprising horizontally and vertically extending elements, pivotally joined to each other, with the vertical element being attachable to the column portion of the bleacher and having a face plate for receiving a part of the adjustment mechanism which is positioned on a bracket near the inner end of the horizontal element.

The manner in which these and other objects and advantages of the invention are achieved in practice will become more clearly apparent when reference is made to the detailed description of the preferred embodiments of the invention set forth by way of example, and shown in the accompanying drawings, in which like reference numbers indicate corresponding parts throughout.

DESCRIPTION OF THE PREFERRED EMBODIMENTS OF THE INVENTION

Although the invention may be embodied in various forms, a description thereof will be made with references to a known type of bleacher construction such as "Interkal" brand bleachers.

Figure 1:
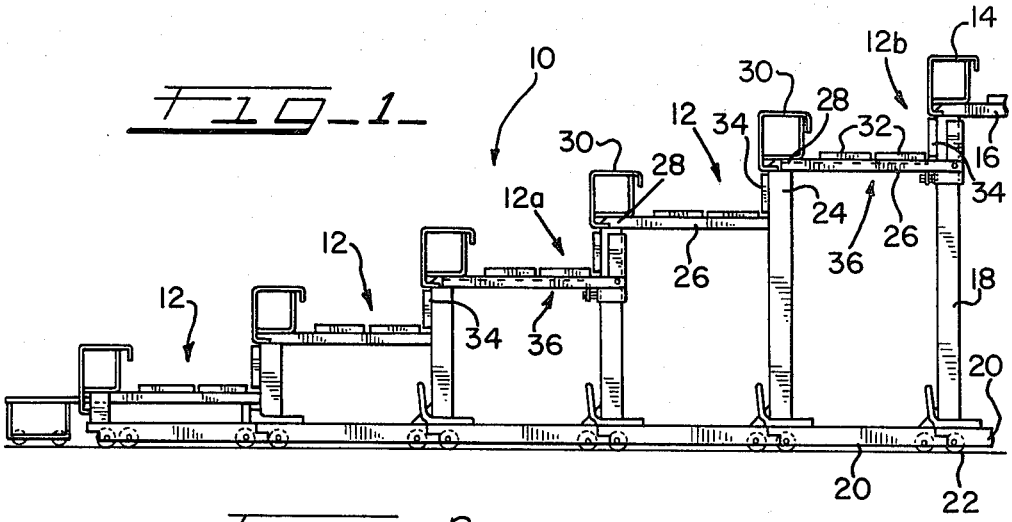
FIG. 1 is a side elevational view of a portion of a folding bleacher assembly in the extended position thereof, showing a plurality of seating units positioned on vertical and horizontal support units which include roller truck assemblies on the lower ends thereof, and showing certain seating units equipped with the adjustable horizontal support units of the invention, in their installed positions of use.

Referring now to the drawings in greater detail, FIG. 1 shows the invention to be embodied in a bleacher assembly generally designated 10 and shown to include a plurality of subsections 12. Each subsection 12 is actually an independent unit, as is well known to those skilled in the art. Inasmuch as the constructional details of the bleachers are described in literature, including that furnished by the Interkal Company of Kalamazoo, Michigan, a detailed description thereof will not be set forth herein.

As shown in FIG. 1, however, for purposes of illustration, each subsection 12 is identical to its counterpart sections except for height. An uppermost seat 14 or the like is typically fixed, as by bracket 16, to a static structure extending outwardly from a reference plane by a predetermined distance, usually equal to or just greater than the front-to-rear length of each subsection 12.

Such subsection 12 includes a principal support means in the form of a column 18, the bottom of which is attached to a dolly 20 containing plural rollers 22. A horizontally extending frame element 26 is attached at its inner end to the column 18 near its upper end, and the outer end 28 of the element 26 receives and supports a seating bench 30. Floorboards 32 are attached to the elements 26, and a kick or riser plate 34 extends upwardly from the inner ends of the elements 26. Thus, the subsections 12 each include a column, a bench, a floorboard unit and the necessary supporting structure. The floorboards 32, the bench 30 and the support element 26 are cantilevered outwardly from the columns, thus straining the elements 26 considerably. Since the dollies 20 and their associated column 18 are offset laterally from each other, the subsections 12 telescope inwardly when desired. As used herein, "inwardly" means to the right in FIG. 1, i.e., toward the inner or retracted position of the bleacher 10.

Figure 2:
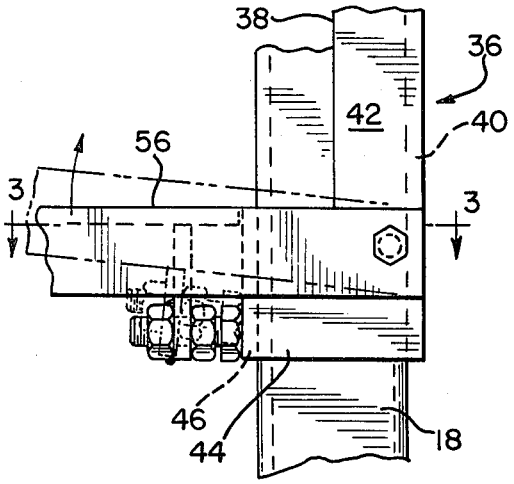
FIG. 2 is a greatly enlarged side elevational view, with portions broken away and showing the construction of the adjustable bleacher support unit.
Figure 4:
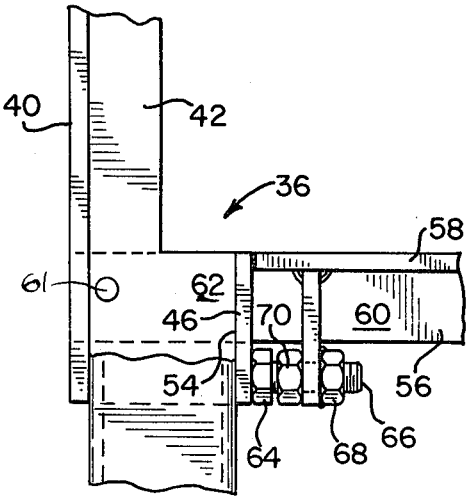
FIG. 4 is a side elevational view similar to that of FIG. 2, having portions broken away but taken from the opposite end thereof.
Figure 3:
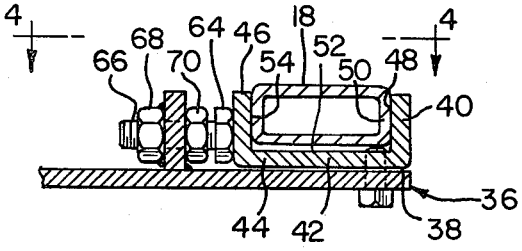
FIG. 3 is a horizontal sectional view of the portion of support unit shown in FIG. 2, taken along lines 3—3 thereof and showing further details of construction.

FIG. 1 shows that, for purposes of illustration, two subsections 12*a* and 12*b* includes the novel reinforcing and positioning units 36 of the invention. Referring now to FIGS. 2–4, the units 36 are shown to include a vertical member 38 having an angular cross section comprising flanges 40, 42, a flange extension 44, and a face plate 46. The inner surface 48 of the flange 40 tightly abuts the rear web 50 of the column 18, the inner surface 52 of the flange 42 lies along a side web of the column 18; and the inner surface 54 of the plate 46 lies along the front surface of the column 18. The member 38 is preferably secured by bolting, but may be welded or brazed thereto.

The horizontal member 56 of the unit 36 includes horizontal and vertical flanges 58, 60, and is pivotally attached by the pin 61 to the vertical member 38. A web or flange 62 is attached to both flanges 58, 60 and extends downwardly from the flange 58, terminating below the lower edge of the flange 60. This flange 62 locates the adjusting and positioning assembly which includes a threaded fastener 64 with a threaded shank 66 extending through a captive nut 68 attached to the flange 62. A lock nut 70 is threaded over the shank 66 and lies inside the flange 62.

As shown best in FIG. 3, the horizontal member or arm 56 may be positioned by rotating the fastener 64. When the head of the fastener engages the face plate 46, the arm cannot move lower. Unscrewing the fastener 64 raises the arm 56, vice versa. When the arm is positioned properly (so the floorboards are horizontal) the lock nut 70 is tightened and the installation is complete. If the floorboards sag, making the adjustment just described will realign the bleachers.

FIG. 1 shows that units 36 are installed in subsections 12*a* and 12*b*, and that flanges 58 engage the floorboards 32 and the benches 30 to provide additional support where necessary. The use of the face plate 46 and the vertical arm 38 provides good stress distribution and overcomes the problem in the prior art which occurred when stress concentrations became too high at the junction of the column and floorboard support element 26, causing bending and or cracking. With the present arrangement, both the front and the rear surfaces or webs 50,54 of the column are used, and the high section modulus of the column can be taken advantage of; the adjusting screw is loaded only in compression and is exceptionally strange.

Actual use has shown the reinforced bleachers to be easily repaired and/or aligned using the present invention, and such bleachers demonstrate a greatly increased potential for longevity at minimum cost in both labor and materials.

It will thus be seen that the present invention provides novel seating structures, having a number of advantages and characteristics including those pointed out above and others which are inherent in the invention. Preferred embodiments of the invention have been described by way of illustration, it is anticipated that changes and modifications of the described seating structures will occur to those skilled in the art and that such changes and modifications may be made without departing from the spirit of the invention or the scope of the appended claims.

I claim:

1. A folding bleacher assembly comprising, in combination, a plurality of individually movable seating units, each seating unit including a pair of support columns, with each column having a wheeled support truck assembly forming the lower portion thereof, and a seat-and-floorboard assembly comprising a plurality of horizontally extending frame elements secured at their inner ends to the upper portions of said support columns, a floor panel assembly resting on the upper surfaces of the intermediate portions of said frame elements, and a seating bench disposed at the outer end of said frame elements and being supported thereby, each of said seat-and-floorboard assemblies further including at least one reinforcing assembly, each of said reinforcing assemblies having a vertically extending portion fixedly attached to said upper portion of said support columns, said vertically extending portion having a face plate forming a portion of the lower end thereof, said face plate lying in use along the outer surface of said column, said reinforcing element also including a horizontally extending support portion adjacent the lower end thereof, said horizontally extending support portion having an upper surface adapted to engage and support said floorboard assemblies and said bench and a sidewall flange extending downwardly from said upper surface thereof, said horizontally extending element further including, adjacent its inner end, a vertically extending adjustment assembly positioning flange, and an adjustment support mechanism having a portion extending through said positioning flange and having a movably positionable inner end portion adapted to engage said face plate to limit the downward movement of said horizontally extending support portion, and to provide for adjustment of horizontally extending support portion.

2. A folding bleacher assembly as defined in claim 1 wherein said at least one reinforcing assembly comprises two assemblies for each of said seat and floorboard assemblies.

3. A folding bleacher assembly as defined in claim 2 wherein said vertically extending portion of said reinforcing assembly further includes a rear flange support snugly engaging a rear surface of its associated column, and a forwardly extending web joining said face plate to the lower portion of said rear flange support.

4. A folding bleacher assembly as defined in claim 1 wherein said adjustment support mechanism includes a threaded fastener, a positioning nut and a lock nut, said inner end comprising the head portion of said fastener.

5. A folding bleacher assembly as defined in claim 3 wherein said horizontally extending support portion is pivotally mounted to said vertically extending portion by a pivot pin extending through both of said horizontally and vertically extending portions.

6. A method of repairing folding bleachers having a seat and floorboard assembly supported by a floor support unit which includes a horizontally extending arm extending outwardly from a column unit, said arm being attached at its inner end to said column adjacent the top of said column, said method comprising attaching to said column a reinforcing assembly which includes a vertical portion lying alongside said column and being supported thereby, and a horizontal portion pivotally attached to said vertical portion adjacent the inner end thereof, said vertical portion having at the bottom thereof a face plate overlying the outer edge of said column, said horizontal portion having an upwardly directed support surface and a reinforcing flange extending downwardly therefrom, and further including an adjustment and positioning assembly including a bracket attached to said arm adjacent the inner end thereof, and adjustment means extending through said bracket and terminating in a head adapted to engage said face plate, and moving said adjustment assembly so as to move said support surface of said horizontal portion into engagement with said seat and floorboard assembly, and continuing movement of said adjusting and positioning assembly until said seat and floorboard assembly is substantially horizontal.

* * * * *